US009161583B2

(12) United States Patent
Glass et al.

(10) Patent No.: US 9,161,583 B2
(45) Date of Patent: Oct. 20, 2015

(54) METHODS AND DEVICES FOR HAIR WEAVE AND HAIR PIECE ATTACHMENT

(71) Applicants: Deborah Glass, Detroit, MI (US); Steve Livneh, Amherstburg (CA); Dong Qian, Amherstburg (CA)

(72) Inventors: Deborah Glass, Detroit, MI (US); Steve Livneh, Amherstburg (CA); Dong Qian, Amherstburg (CA)

( * ) Notice: Subject to any disclaimer, the term of this patent is extended or adjusted under 35 U.S.C. 154(b) by 0 days.

(21) Appl. No.: 13/662,514

(22) Filed: Oct. 28, 2012

(65) Prior Publication Data

US 2013/0263871 A1 Oct. 10, 2013

Related U.S. Application Data

(63) Continuation-in-part of application No. 29/435,564, filed on Oct. 25, 2012, now Pat. No. Des. 706,486, and a continuation-in-part of application No. 29/394,792, filed on Jun. 21, 2011, now abandoned.

(60) Provisional application No. 61/654,904, filed on Jun. 3, 2012, provisional application No. 61/552,668, filed on Oct. 28, 2011.

(51) Int. Cl.
*A41G 5/00* (2006.01)
*A45D 8/12* (2006.01)

(52) U.S. Cl.
CPC ..... *A41G 5/0073* (2013.01)

(58) Field of Classification Search
CPC . A41G 5/0013; A41G 5/0026; A41G 5/0053; A41G 5/0066; A41G 5/0073; A41G 5/0086; A41G 5/0093; Y10T 24/46; Y10T 24/4618; Y10T 24/4638; Y10T 24/45319; A45D 8/12
USPC ..... 132/53–56, 201, 212, 144, 105, 219, 132/273, 275, 276, 278, 280, 284, 158–160, 132/901, 60, 61, 146, 154, 279, 281, 282, 132/283, 128–130, 132, 133, 145; D28/21, D28/32, 39–43, 92, 93, 22, 33, 34; 446/394; 24/706, 706.1, 706.3, 707.8, 531, 532, 24/707
See application file for complete search history.

(56) References Cited

U.S. PATENT DOCUMENTS

| | | | | | |
|---|---|---|---|---|---|
| 250,967 | A | * | 12/1881 | Presser | 132/105 |
| 459,000 | A | * | 9/1891 | Emery | 132/105 |
| 1,526,440 | A | * | 2/1925 | Skaruda | 132/105 |
| 1,540,102 | A | * | 6/1925 | Cohen | 132/105 |
| 1,775,209 | A | * | 9/1930 | Oppenheim | 132/105 |
| 2,651,310 | A | * | 9/1953 | Selson | 132/274 |
| 3,669,129 | A | * | 6/1972 | Serebrin | 132/281 |

(Continued)

*Primary Examiner* — Vanitha Elgart
(74) *Attorney, Agent, or Firm* — Preston Smirman; Smirman IP Law, PLLC

(57) ABSTRACT

Methods and devices for attaching hair weaves to a wearer's existing hair are described. A hair extension/weave portion (e.g., a system comprised of a plurality of natural and/or synthetic hair strands) may be attached to an attachment strip member via a base member with a suture, such as a thread or stitch. The attachment strip member may be formed of a flexible material, such that it can conform to the contours of the wearer's head/scalp. Holes may be provided on the attachment strip member so to allow the attachment of one or more clip members thereto. The clip members, having the attachment strip member and hair extension portion attached thereto, may then be inserted into the wearer's existing hair so as to secure the hair extension system thereto. The clip members, and thus the hair extension system, may then be easily removed from the wearer's existing hair when desired.

30 Claims, 21 Drawing Sheets

(56) References Cited

U.S. PATENT DOCUMENTS

| | | | | | |
|---|---|---|---|---|---|
| 3,699,978 | A | * | 10/1972 | Holly | 132/53 |
| 4,155,370 | A | * | 5/1979 | Nemoto | 132/53 |
| 4,168,713 | A | * | 9/1979 | Agiotis | 132/53 |
| 4,254,783 | A | * | 3/1981 | Kim | 132/105 |
| D278,940 | S | * | 5/1985 | Incando | D28/93 |
| 4,522,215 | A | * | 6/1985 | Verducci | 132/219 |
| 5,137,037 | A | * | 8/1992 | Mochizuki | 132/53 |
| D356,398 | S | | 3/1995 | Hafid | |
| D376,444 | S | * | 12/1996 | Buckwalter | D28/92 |
| 5,813,418 | A | * | 9/1998 | Pillars | 132/201 |
| 5,937,867 | A | * | 8/1999 | Williams | 132/201 |
| 6,019,107 | A | * | 2/2000 | Overmyer et al. | 132/53 |
| 6,035,861 | A | * | 3/2000 | Copello | 132/201 |
| 6,273,097 | B1 | * | 8/2001 | Sartena | 132/275 |
| 6,298,861 | B1 | * | 10/2001 | Kageyama et al. | 132/53 |
| 6,405,736 | B2 | | 6/2002 | Townsend | |
| 6,494,212 | B1 | * | 12/2002 | Yamakoshi | 132/53 |
| 6,634,366 | B1 | * | 10/2003 | Simmons et al. | 132/53 |
| 6,883,525 | B2 | | 4/2005 | Lee et al. | |
| D615,244 | S | * | 5/2010 | Hsu | D28/32 |
| D615,703 | S | * | 5/2010 | Hsu | D28/40 |
| 7,743,774 | B2 | | 6/2010 | Lane | |
| D630,801 | S | * | 1/2011 | Umezu et al. | D28/93 |
| D642,744 | S | * | 8/2011 | Hunt-Larder | D28/92 |
| 8,191,556 | B2 | * | 6/2012 | Betts | 132/201 |
| 2001/0037813 | A1 | * | 11/2001 | Ra | 132/53 |
| 2004/0129285 | A1 | | 7/2004 | Frazier | |
| 2004/0163660 | A1 | * | 8/2004 | Kellmann | 132/201 |
| 2004/0200494 | A1 | * | 10/2004 | Lee | 132/53 |
| 2005/0092341 | A1 | * | 5/2005 | Padilla | 132/201 |
| 2005/0194015 | A1 | * | 9/2005 | Watts | 132/53 |
| 2006/0005849 | A1 | * | 1/2006 | Thomas-Dupree | 132/54 |
| 2006/0180171 | A1 | | 8/2006 | Kim | |
| 2008/0110472 | A1 | * | 5/2008 | Kaweblum | 132/276 |
| 2008/0236605 | A1 | | 10/2008 | Russo | |
| 2008/0257369 | A1 | * | 10/2008 | Poole | 132/53 |
| 2008/0276949 | A1 | | 11/2008 | Lee | |
| 2008/0295856 | A1 | | 12/2008 | Kallabat et al. | |
| 2009/0188512 | A1 | * | 7/2009 | Eaton | 132/54 |
| 2010/0139679 | A1 | * | 6/2010 | Umezu et al. | 132/106 |
| 2010/0170523 | A1 | | 7/2010 | Depalma | |
| 2011/0005544 | A1 | * | 1/2011 | Lane | 132/201 |
| 2011/0180091 | A1 | * | 7/2011 | Wilson | 132/201 |
| 2012/0125356 | A1 | * | 5/2012 | Alex | 132/201 |

* cited by examiner

METHODS AND DEVICES FOR HAIR WEAVE AND HAIR PIECE ATTACHMENT

CROSS-REFERENCE TO RELATED APPLICATION

The instant application claims priority to U.S. Provisional Patent Application Ser. No. 61/654,904, filed Jun. 3, 2012, U.S. Provisional Patent Application Ser. No. 61/552,668, filed Oct. 28, 2011, is a continuation in part of U.S. Design patent application Ser. No. 29/435, 564 filed Oct. 25, 2012, pending, and is a continuation in part of U.S. Design patent application Ser. No. 29/394,792, filed Jun. 21, 2011, pending, the entire specifications of all of which are expressly incorporated herein by reference.

FIELD OF INVENTION

The present invention relates generally to human and man-made hair addition and attachment methods and more specifically to new and improved methods and devices for attaching hair weaves to a wearer's existing hair, especially those wearers having coarse hair, such as but not limited to African types of hair.

BACKGROUND OF INVENTION

The use of wigs, toupees, hair weaves and hair extensions has been practiced for many years and by many different cultures and civilizations. However, in the past few decades, there has been a growing trend to use hair weaves as an addition to women's existing hair, e.g., to provide better aesthetics, as well as to compensate for poor natural hair quality or to cover up thinning areas of the scalp. Although, this trend is present in most cultures, it has become increasing popular with women of African descent, who typically have naturally coarse and/or highly curled hair.

Hair weaves generally differ from conventional wigs by being an "add-on" component to the wearer's existing and partially visible hair. By adding hair weaves, the wearer has the advantage of adding fullness and style to her (or his) hair. Hair weaves usually are commercially available in packages containing 3-4 ounces of hair that has been sewn together in one or more layers to form a continuous strip. The hair length varies, usually within the range of 4-22 inches, wherein most wearers opt for 10-16 inches as a suitable length that allows for further trimming and styling.

Presently, conventional hair weaves are cut to the desired width and then attached to the user's existing hair by the following methods: (1) special clips are mostly used by Caucasian and Asian users having generally straight or wavy hair; however, these clips do not hold well onto African/black ethnic hair; (2) the hair weaves may be sewn onto the users' hair; and/or (3) the hair weaves may be glued onto the user's hair.

The issues related to the latter methods (i.e., gluing and/or sewing) are numerous, including: (1) sewing and gluing are time consuming and expensive; (2) sewing and gluing must be done by a hair dresser or a trained individual; (3) sewing and gluing do not allow for removal of weaves from time to time, e.g., to wash the owner's hair; and/or (4) gluing may cause allergies and emit undesired odors.

Accordingly, there exists a need for new and improved methods and devices for attaching hair weaves to a wearer's existing hair, especially those wearers having coarse hair, such as but not limited to African types of hair.

SUMMARY OF THE INVENTION

In accordance with the general teachings of the present invention, new and improved methods and devices for attaching hair weaves and hair extensions to a wearer's existing hair, especially those wearers having coarse hair, such as but not limited to African types of hair, are provided.

In accordance with a first embodiment of the present invention, a hair extension clip system is provided, comprising:

a hair extension member;

a base member, wherein the hair extension member is fastened to a portion of the base member;

an attachment strip member, wherein the base member is fastened to a portion of the attachment strip member; and a clip member, wherein a portion of the clip member is operably associated with the attachment strip member;

wherein the clip member is selectively operable to engage a portion of a wearer's existing hair.

In accordance with a second embodiment of the present invention, a hair extension clip system is provided, comprising:

a hair extension system;

an attachment strip member, wherein a portion of the hair extension system is fastened to a portion of the attachment strip member; and a clip member, wherein a portion of the clip member is operably associated with the attachment strip member;

wherein the clip member is selectively operable to engage a portion of a wearer's existing hair.

Further areas of applicability of the present invention will become apparent from the detailed description provided hereinafter. It should be understood that the detailed description and specific examples, while indicating the preferred embodiment of the invention, are intended for purposed of illustration only and are not intended to limit the scope of the invention.

BRIEF DESCRIPTION OF THE DRAWINGS

Other advantages of the present invention will be readily appreciated as the same becomes better understood by reference to the following detailed description when considered in connection with the accompanying drawings wherein.

The same reference numerals refer to the same parts throughout the various Figures.

DETAILED DESCRIPTION OF THE PRESENT INVENTION

Figure 1:
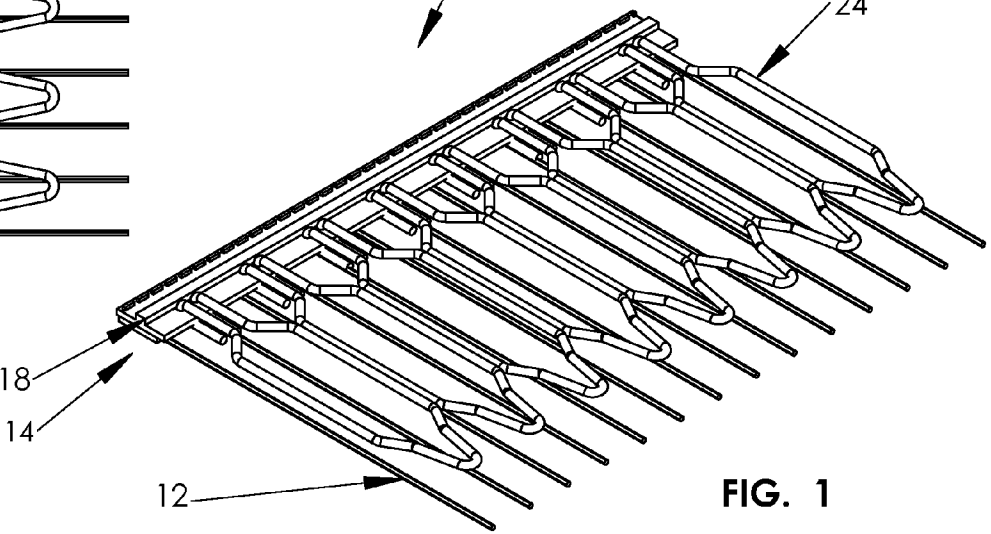
FIG. 1 is a perspective view of a hair extension clip system, in accordance with a first embodiment of the present invention.
Figure 2:
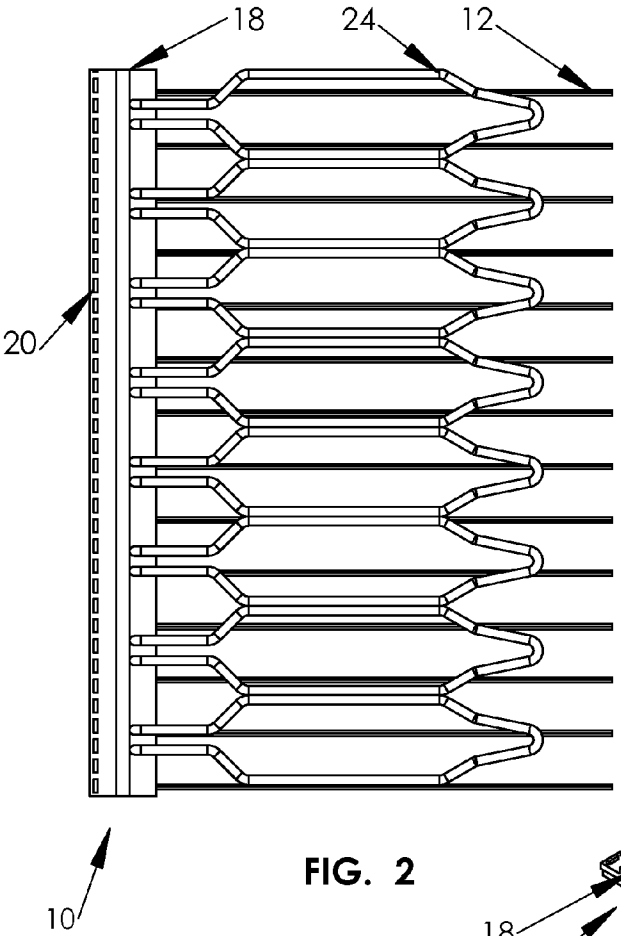
FIG. 2 is a front view of the hair extension clip system depicted in FIG. 1, in accordance with a fifth embodiment of the present invention.
Figure 1C:
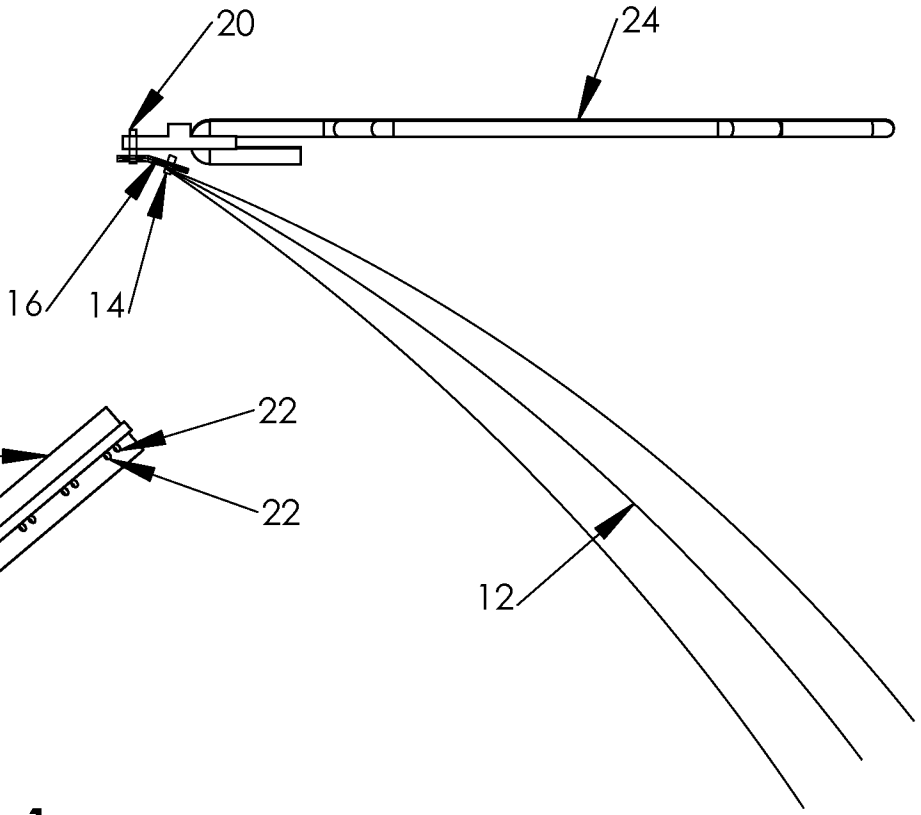
FIG. 1*c* is a side view of the hair extension clip system depicted in FIG. 1, in accordance with a fourth embodiment of the present invention.
Figure 1B:
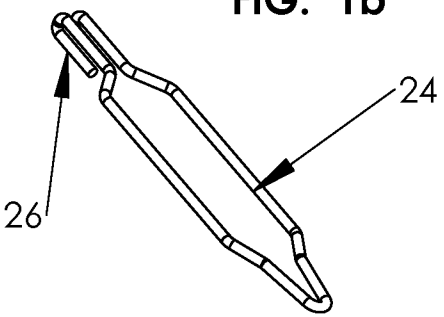
FIG. 1*b* is a perspective view of a hair clip member of the hair extension clip system depicted in FIG. 1, in accordance with a third embodiment of the present invention.
Figure 1A:
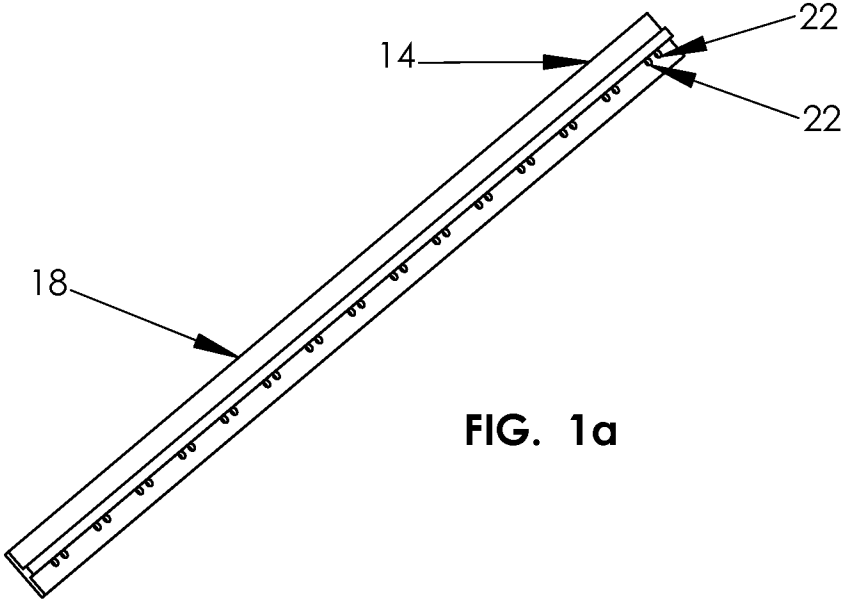
FIG. 1*a* is a perspective view of an attachment strip member of the hair extension clip system depicted in FIG. 1, in accordance with a second embodiment of the present invention.
Figure 3:
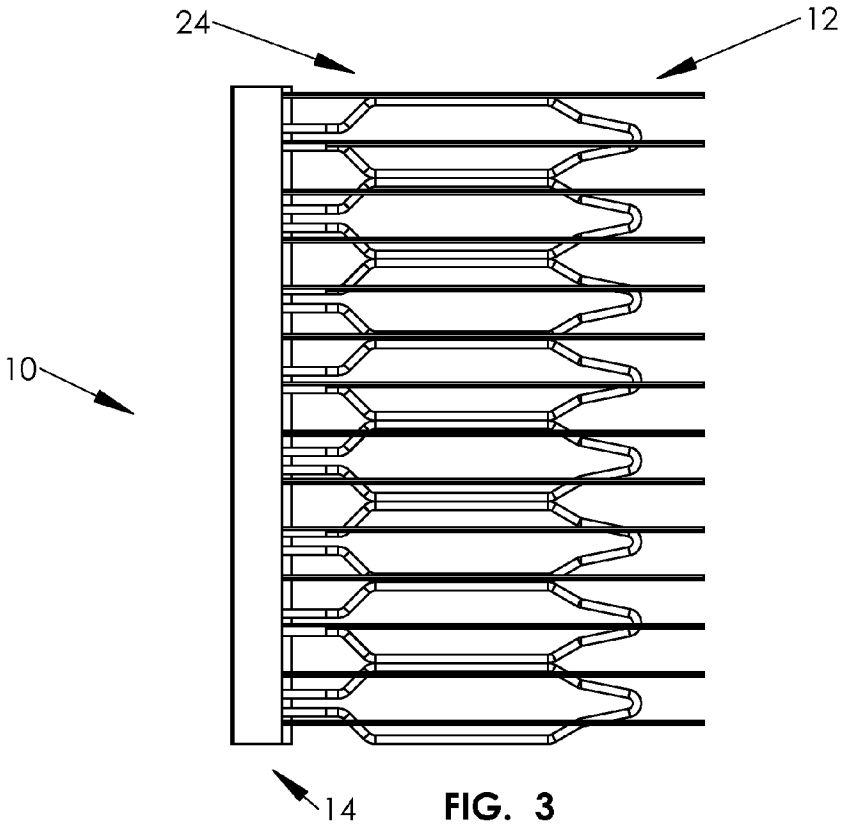
FIG. 3 is a rear view of the hair extension clip system depicted in FIG. 1, in accordance with a sixth embodiment of the present invention.
Figure 4:
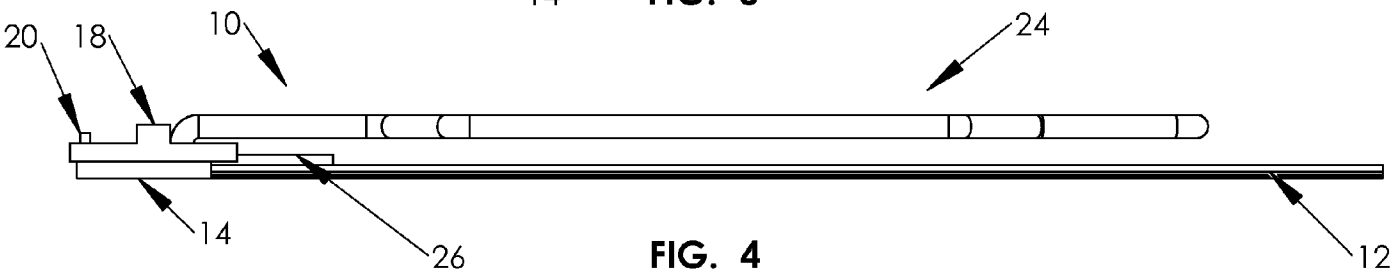
FIG. 4 is an elevational view of the hair extension clip system depicted in FIG. 1, in accordance with a seventh embodiment of the present invention.
Figure 5:
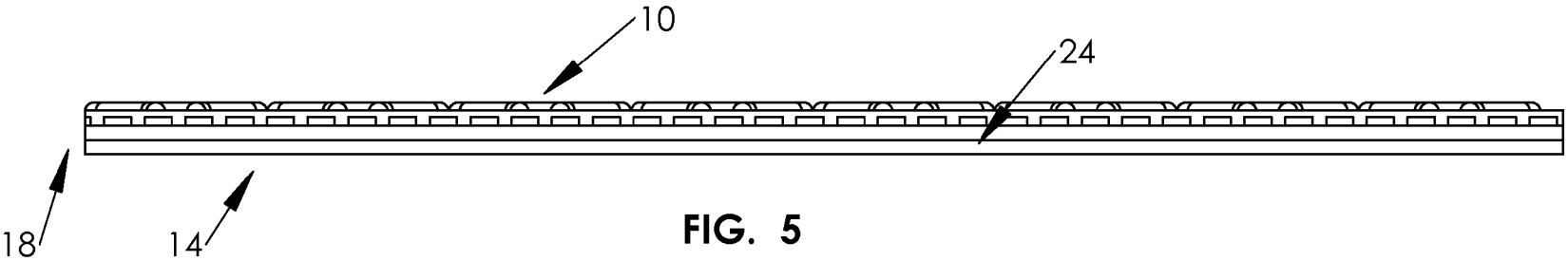
FIG. 5 is a top view of the hair extension clip system depicted in FIG. 1, in accordance with an eighth embodiment of the present invention.
Figure 6:
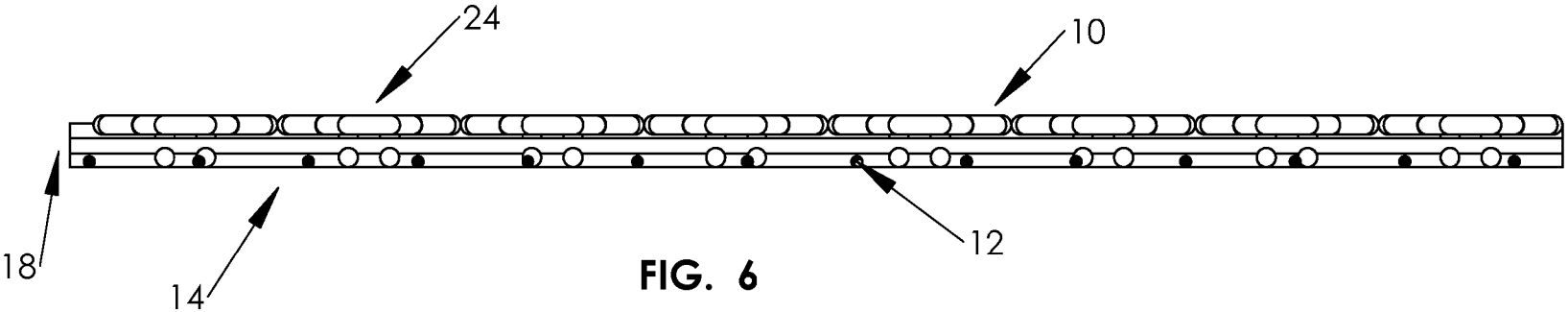
FIG. 6 is a bottom view of the hair extension clip system depicted in FIG. 1, in accordance with a ninth embodiment of the present invention.
Figure 7:
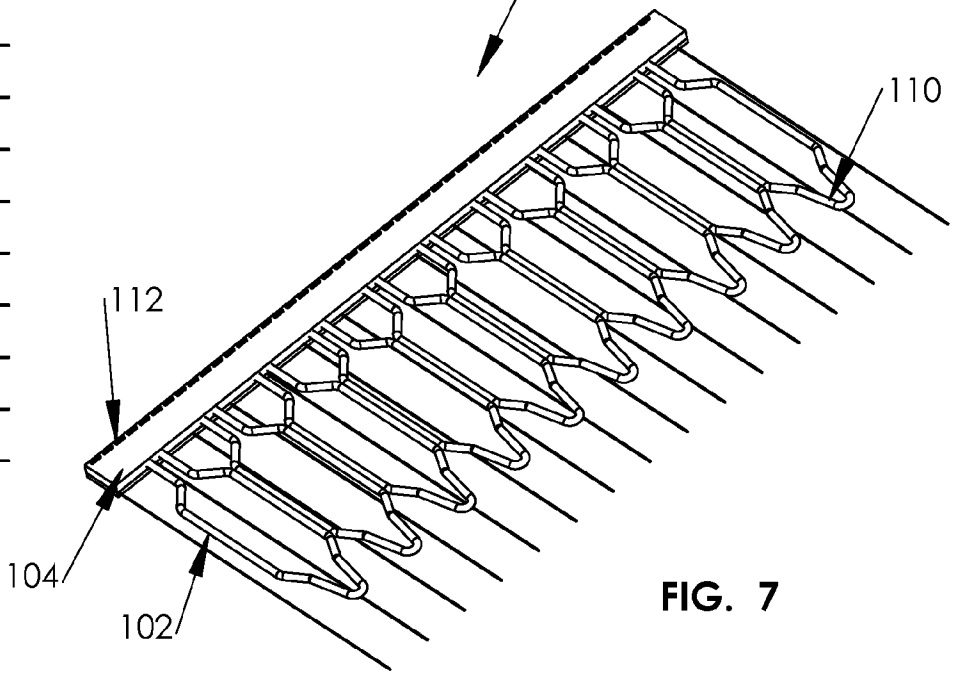
FIG. 7 is a perspective view of a first alternative hair extension clip system, in accordance with a tenth embodiment of the present invention.
Figure 8:
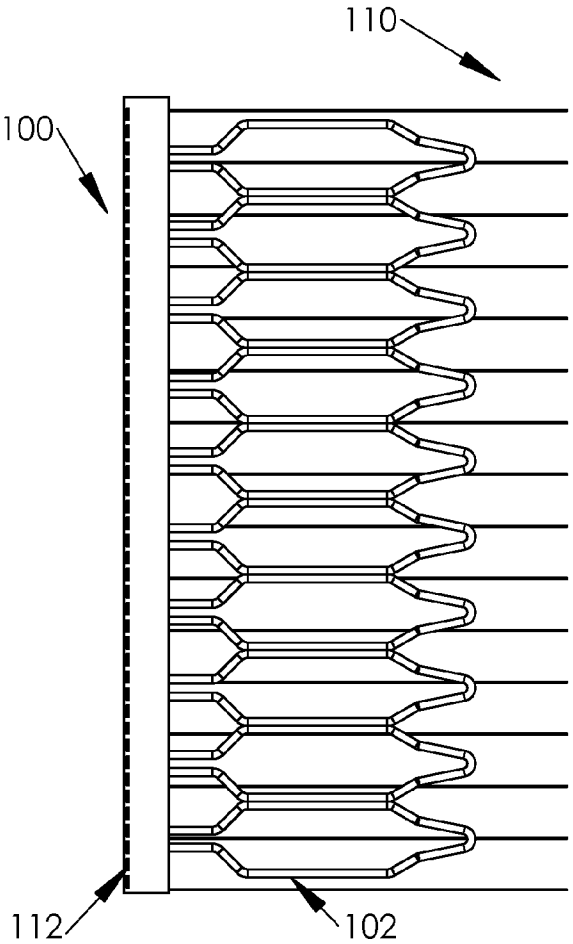
FIG. 8 is a front view of the first alternative hair extension clip system depicted in FIG. 7, in accordance with a fourteenth embodiment of the present invention.
Figure 7C:
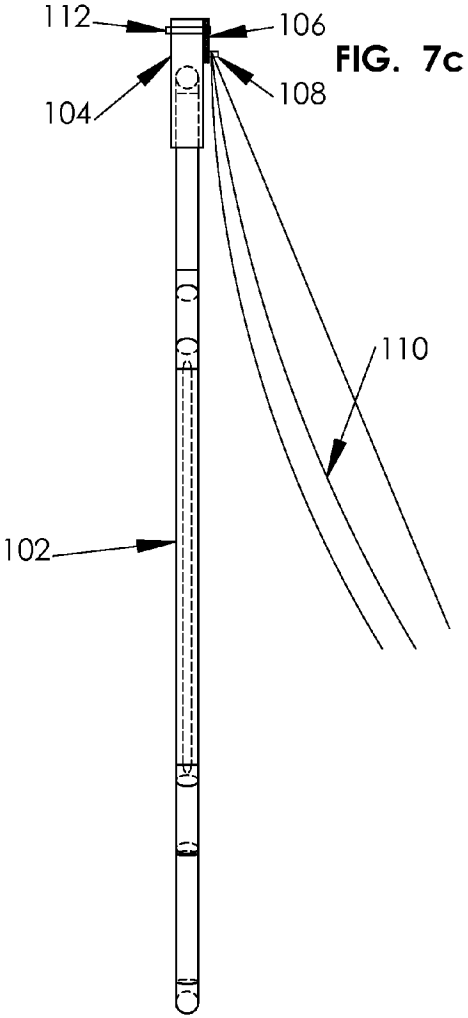
FIG. 7*c* is a side view of the hair extension clip system depicted in FIG. 7, in accordance with a thirteenth embodiment of the present invention.
Figure 7A:
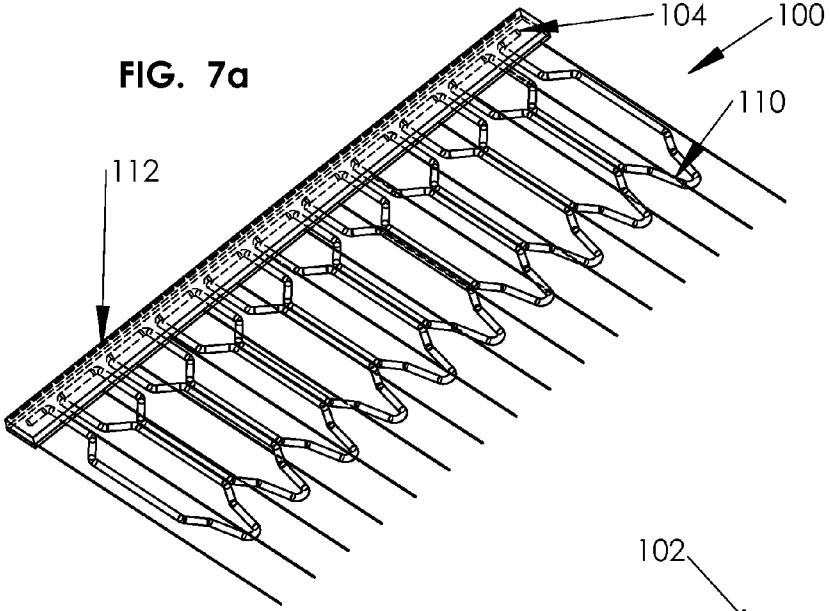
FIG. 7*a* is a partial broken away view of the hair extension clip system depicted in FIG. 7, in accordance with an eleventh embodiment of the present invention.
Figure 7B:
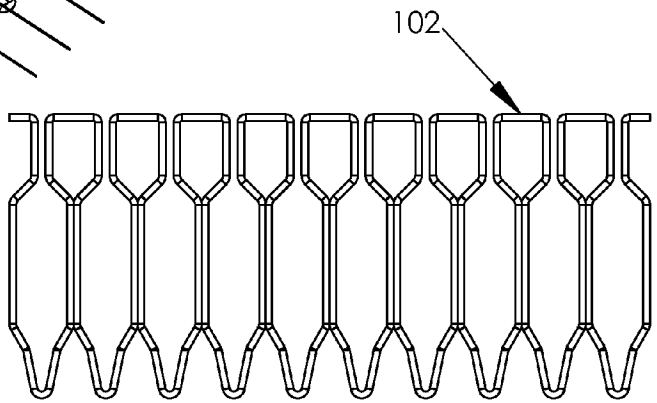
FIG. 7*b* is an elevational view of a hair clip member depicted in FIG. 7, in accordance with a twelfth embodiment of the present invention.
Figure 9:
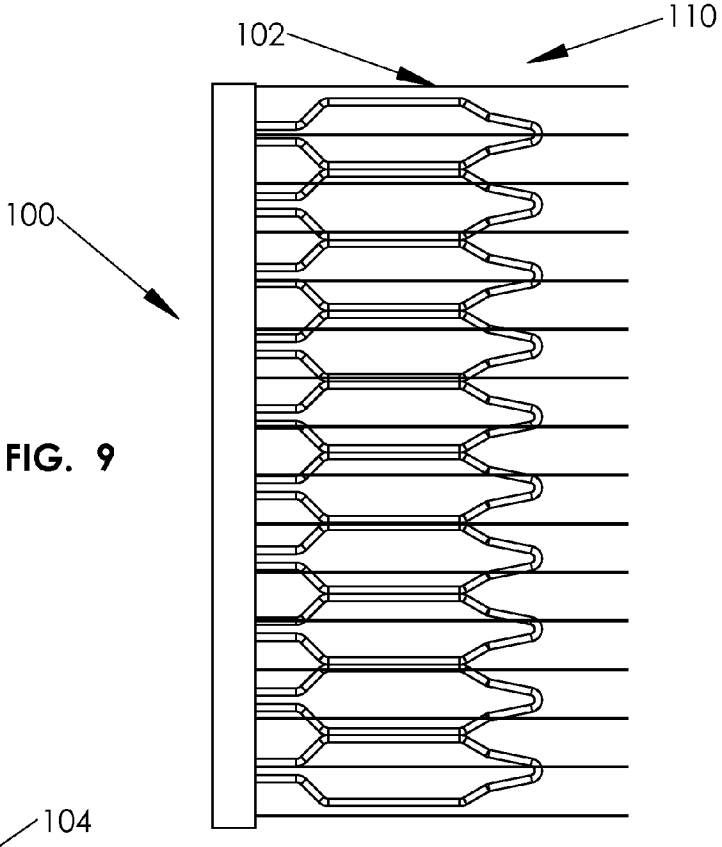
FIG. 9 is a rear view of the first alternative hair extension clip system depicted in FIG. 7, in accordance with a fifteenth embodiment of the present invention.
Figure 10:
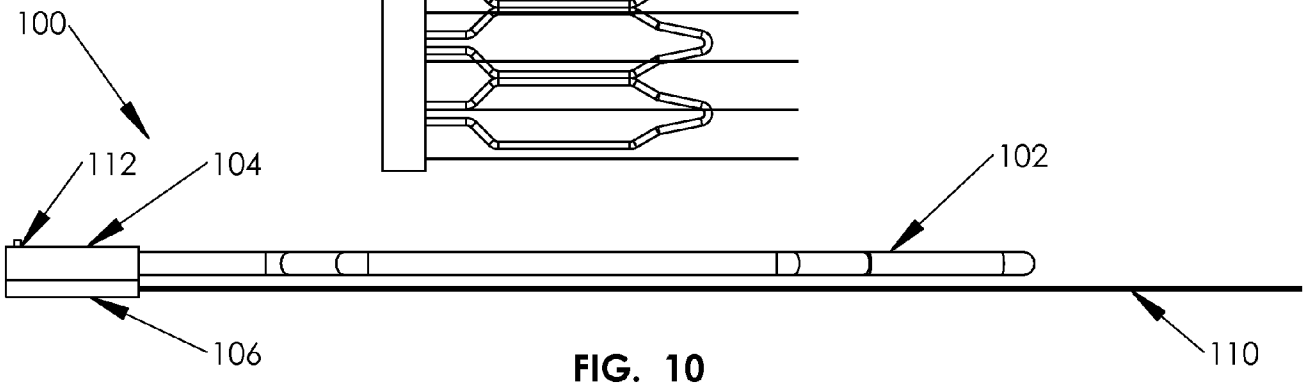
FIG. 10 is an elevational view of the first alternative hair extension clip system depicted in FIG. 7, in accordance with a sixteenth embodiment of the present invention.
Figure 12:
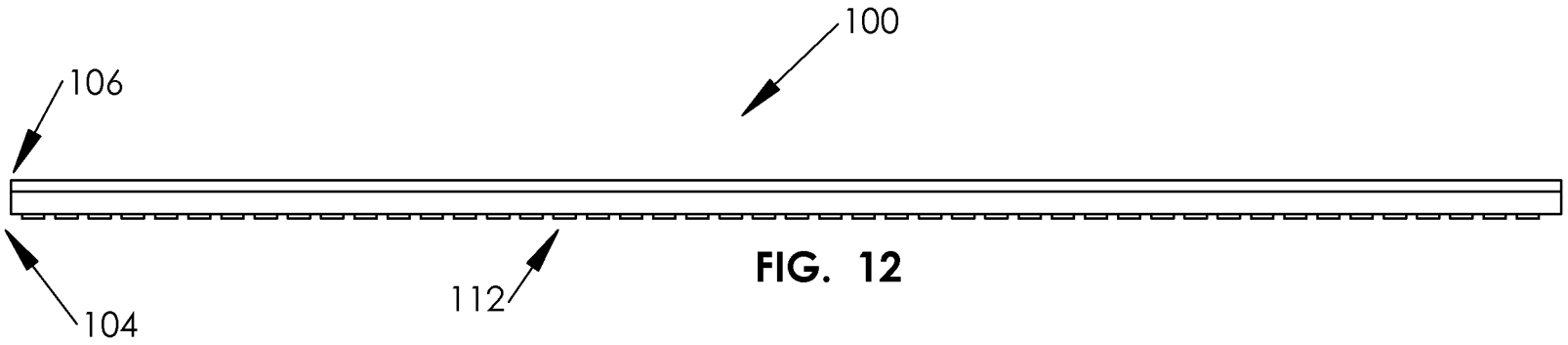
FIG. 12 is a bottom view of the first alternative hair extension clip system depicted in FIG. 7, in accordance with an eighteenth embodiment of the present invention.
Figure 11:
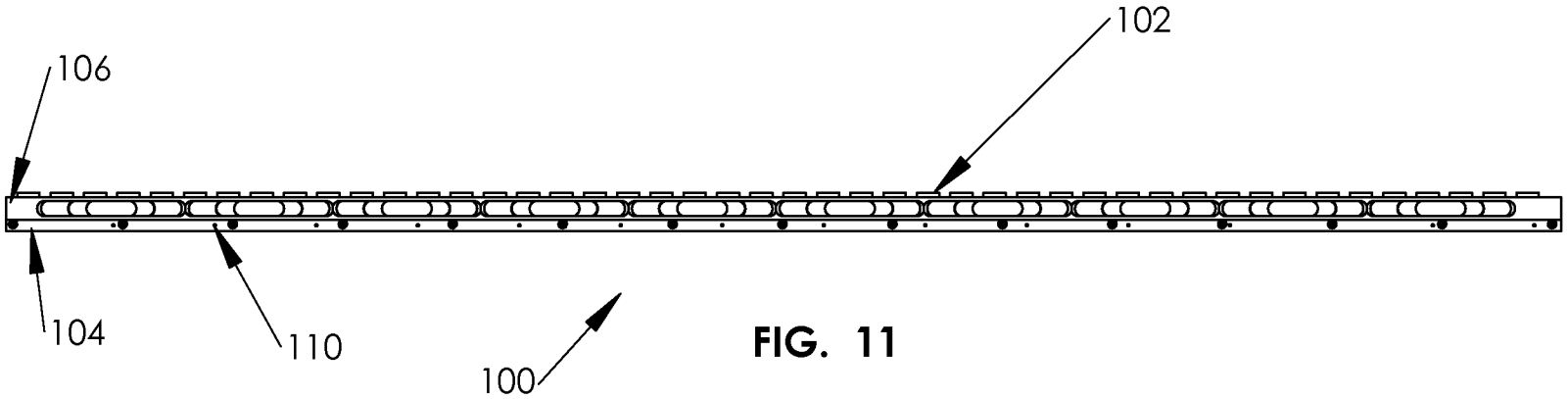
FIG. 11 is a top view of the first alternative hair extension clip system depicted in FIG. 7, in accordance with a seventeenth embodiment of the present invention.
Figure 13:
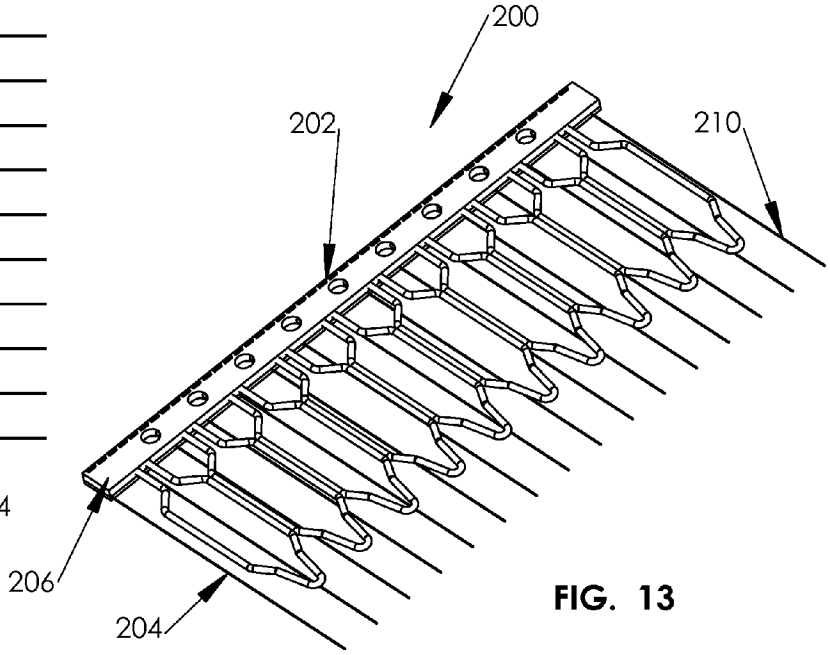
FIG. 13 is a perspective view of a second alternative hair extension clip system, in accordance with a nineteenth embodiment of the present invention.
Figure 14:
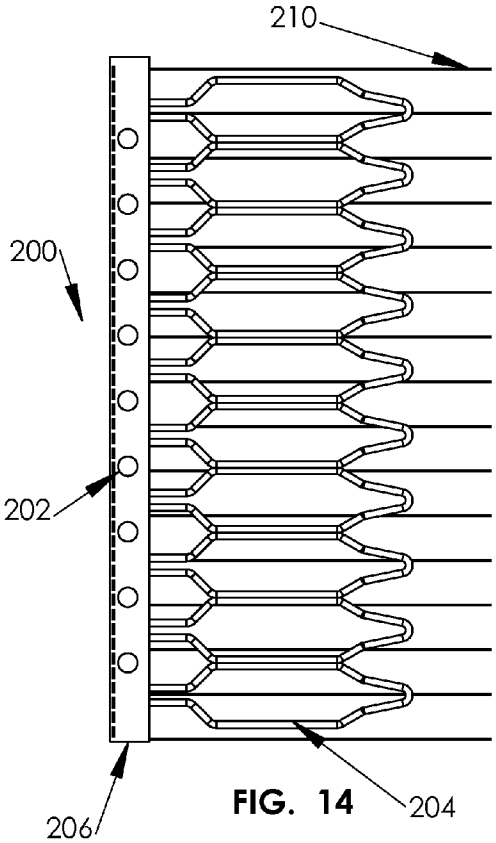
FIG. 14 is a front view of the second alternative hair extension clip system depicted in FIG. 13, in accordance with a twenty-third embodiment of the present invention.
Figure 13C:
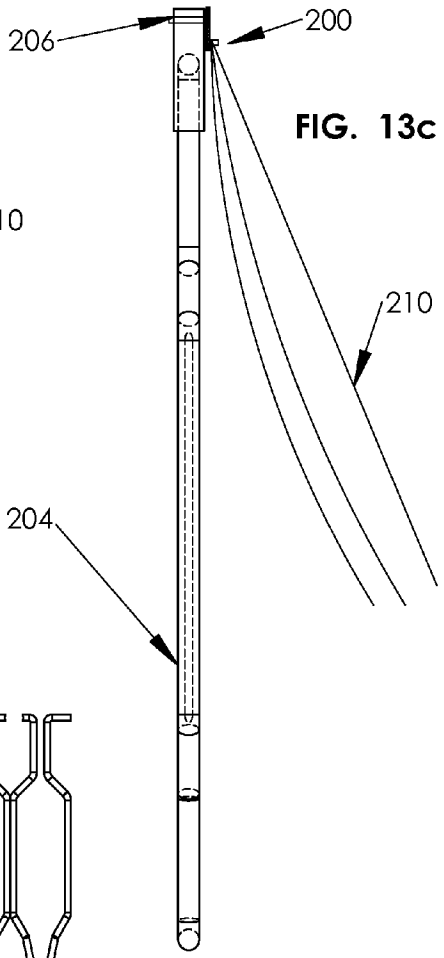
FIG. 13*c* is a side view of the second alternative hair extension clip system depicted in FIG. 13, in accordance with a twenty-second embodiment of the present invention.
Figure 13A:
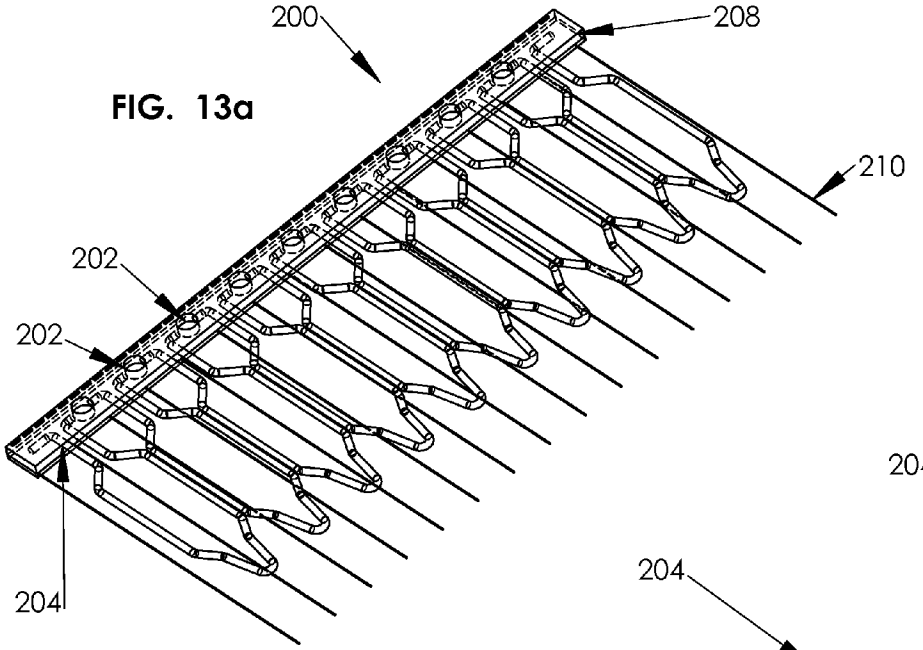
FIG. 13*a* is a partial broken away view of the second alternative hair extension clip system depicted in FIG. 13, in accordance with a twentieth embodiment of the present invention.
Figure 13B:
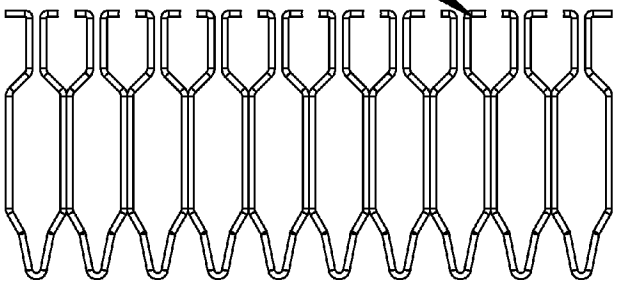
FIG. 13*b* is an elevational broken away view of a hair clip member of the second alternative hair extension clip system depicted in FIG. 13, in accordance with a twenty-first embodiment of the present invention.
Figure 15:
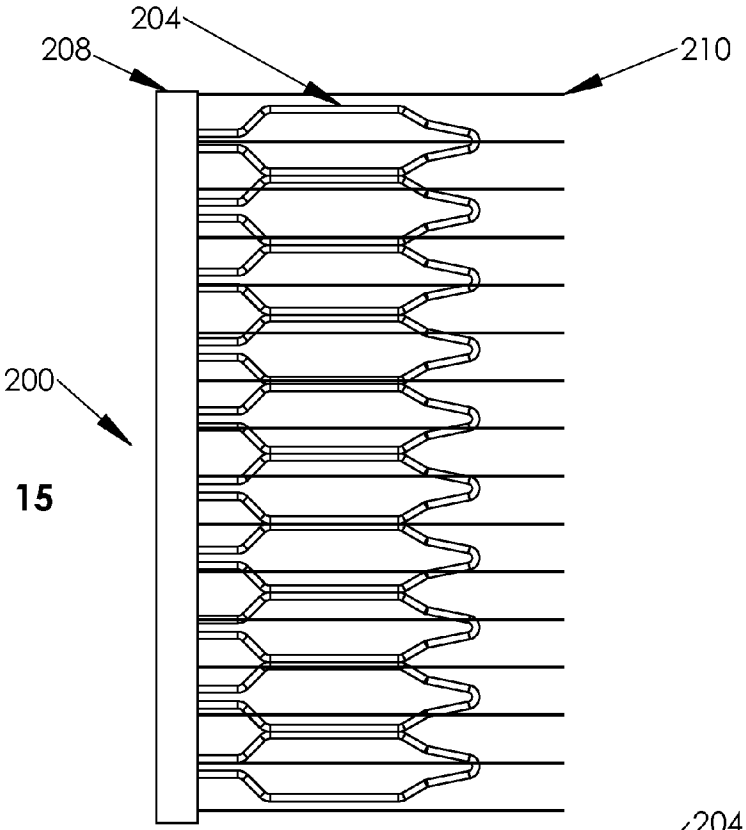
FIG. 15 is a rear view of the second alternative hair extension clip system depicted in FIG. 13, in accordance with a twenty-fourth embodiment of the present invention.
Figure 16:
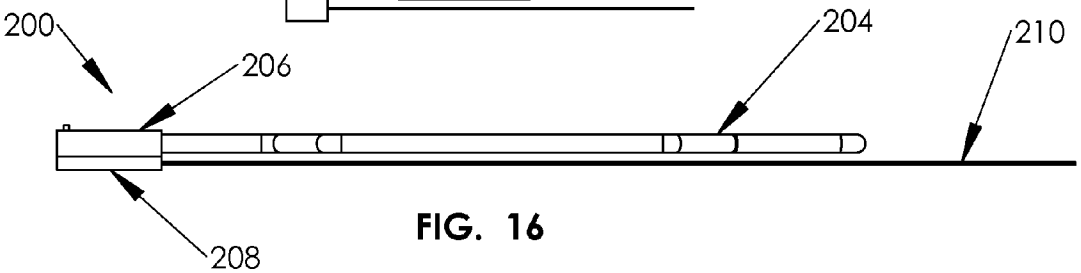
FIG. 16 is an elevational view of the second alternative hair extension clip system depicted in FIG. 13, in accordance with a twenty-fifth embodiment of the present invention.
Figure 17:
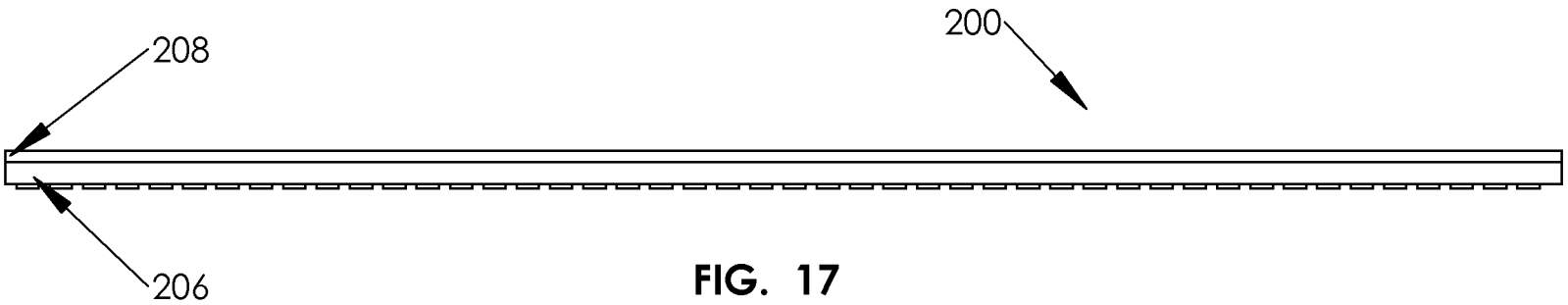
FIG. 17 is a top view of the second alternative hair extension clip system depicted in FIG. 13, in accordance with a twenty-sixth embodiment of the present invention.
Figure 18:
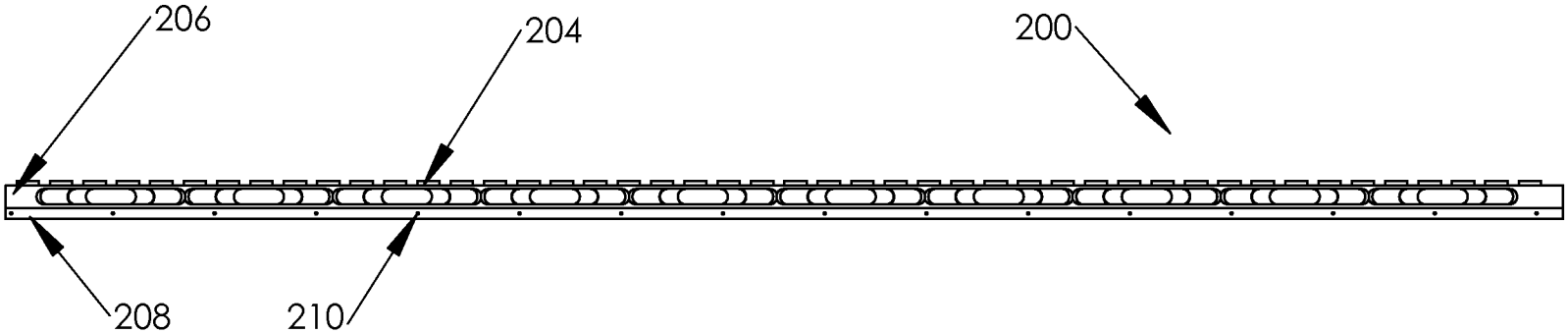
FIG. 18 is a bottom view of the second alternative hair extension clip system depicted in FIG. 13, in accordance with a twenty-seventh embodiment of the present invention.
Figure 19:
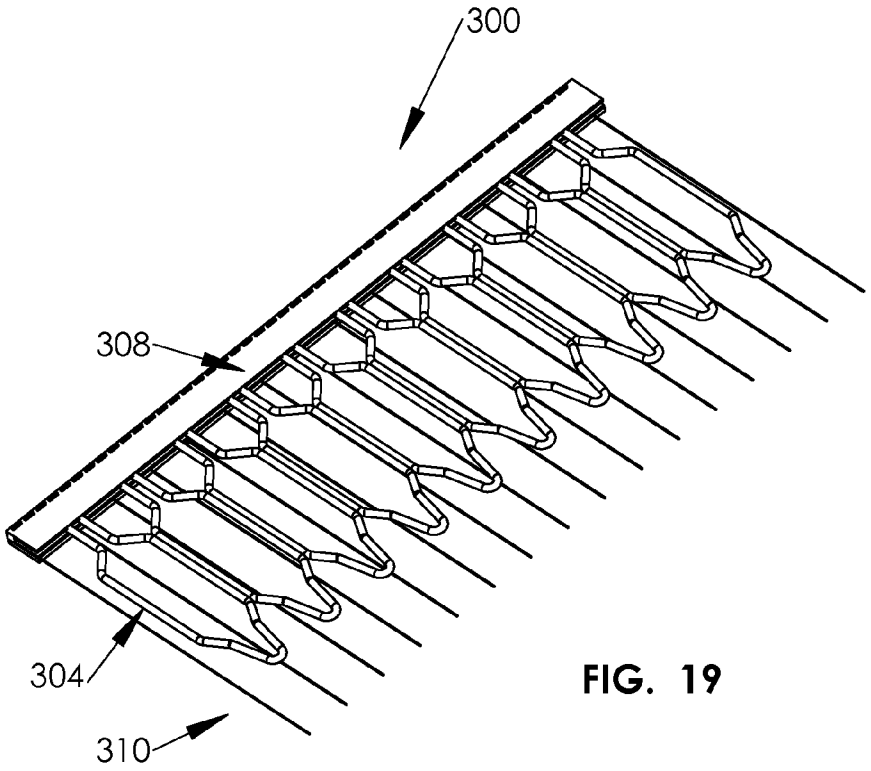
FIG. 19 is a perspective view of a third alternative hair extension clip system, in accordance with a twenty-eighth embodiment of the present invention.
Figure 20:
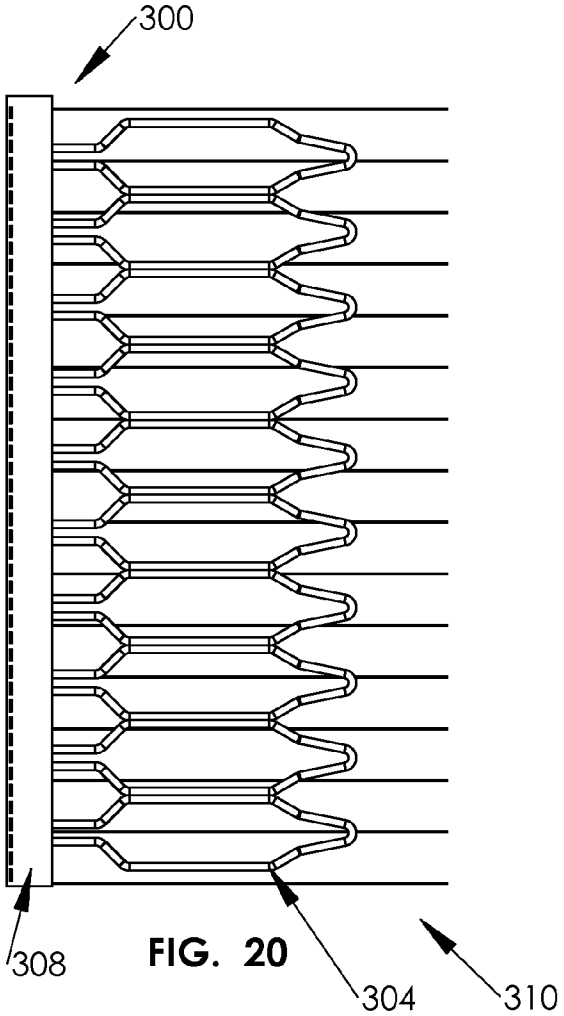
FIG. 20 is a front view of the third alternative hair extension clip system depicted in FIG. 19, in accordance with a thirty-third embodiment of the present invention.
Figure 19D:
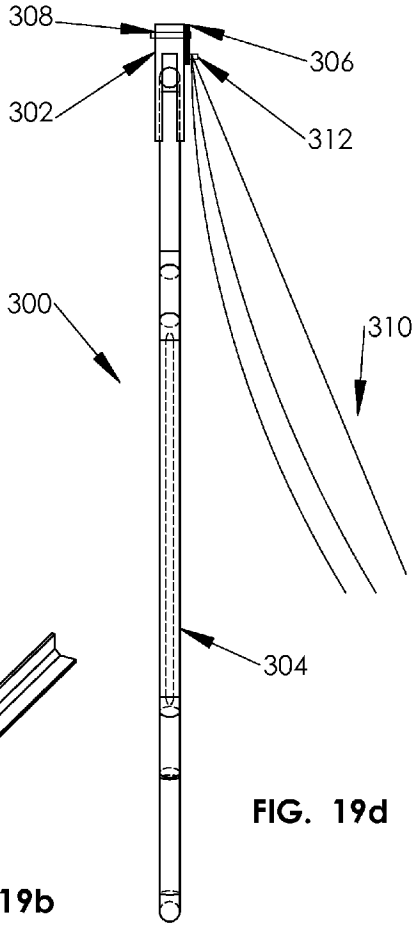
FIG. 19*d* is a side view of the third alternative hair extension clip system depicted in FIG. 19, in accordance with a thirty-second embodiment of the present invention.
Figure 19B:
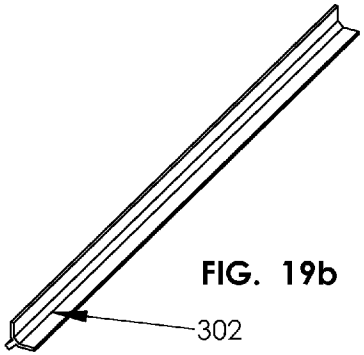
FIG. 19*b* is a perspective view of an attachment strip member of the third alternative hair extension clip system depicted in FIG. 19, in accordance with a thirtieth embodiment of the present invention.
Figure 19A:
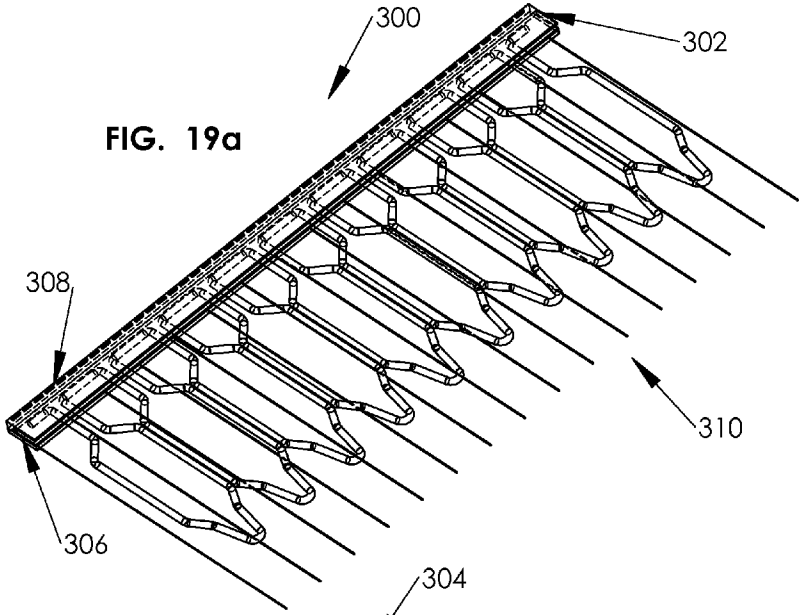
FIG. 19*a* is a partial broken away view of the third alternative hair extension clip system depicted in FIG. 19, in accordance with a twenty-ninth embodiment of the present invention.
Figure 19C:
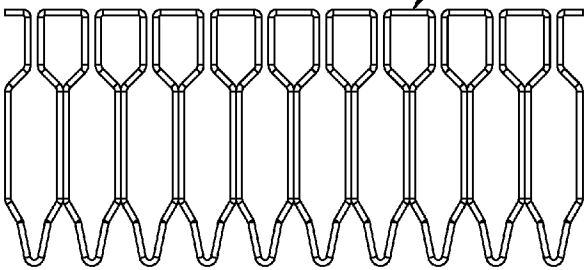
FIG. 19*c* is a perspective view of a hair clip member of the third alternative hair extension clip system depicted in FIG. 19, in accordance with a thirty-first embodiment of the present invention.
Figure 21:
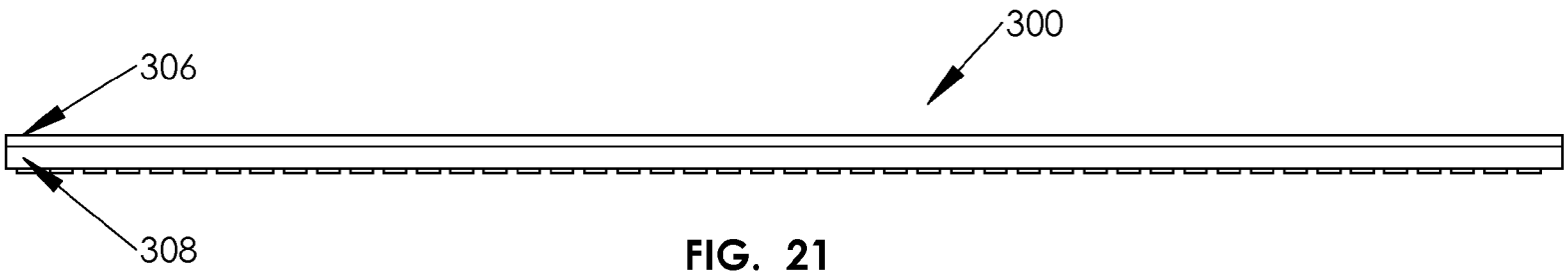
FIG. 21 is a top view of the third alternative hair extension clip system depicted in FIG. 19, in accordance with a thirty-fourth embodiment of the present invention.
Figure 22:
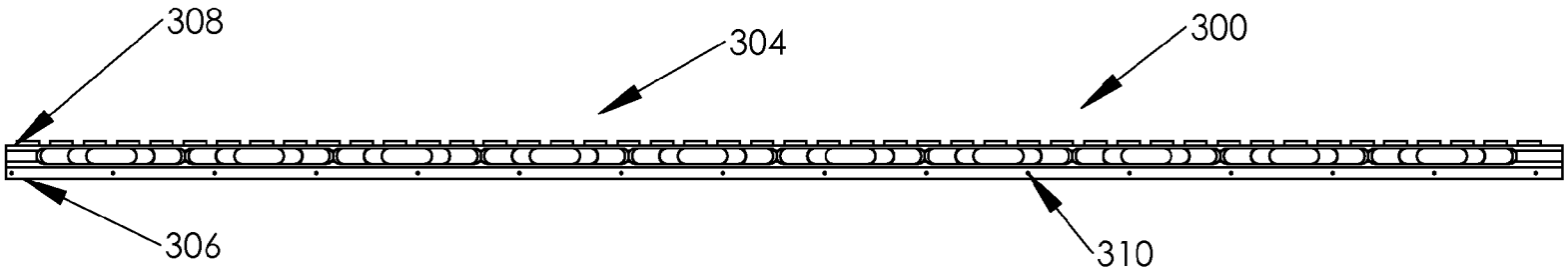
FIG. 22 is a bottom view of the third alternative hair extension clip system depicted in FIG. 19, in accordance with a thirty-fifth embodiment of the present invention.
Figure 23:
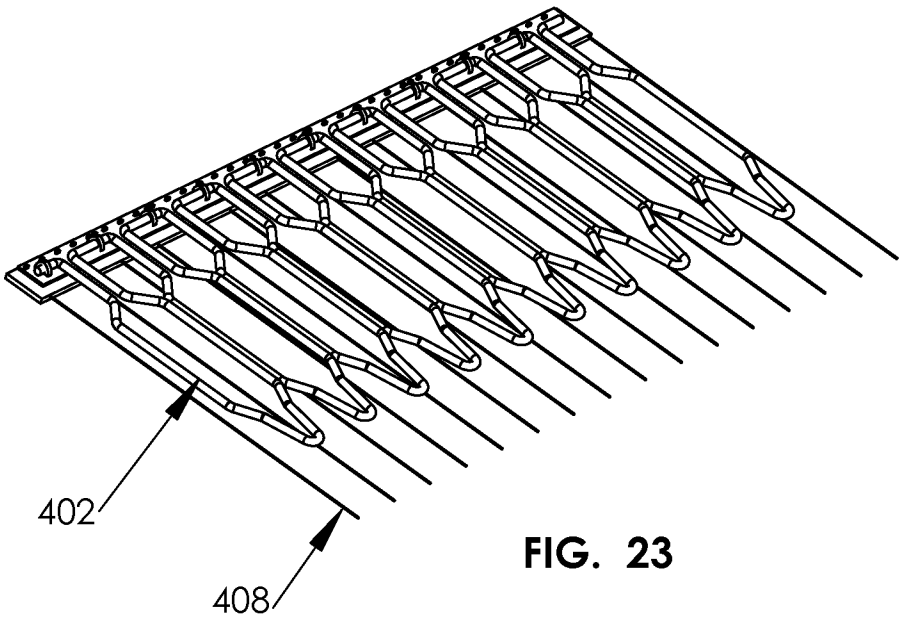
FIG. 23 is a perspective view of a fourth alternative design for a hair extension clip system, in accordance with a thirty-sixth embodiment of the present invention.
Figure 24:
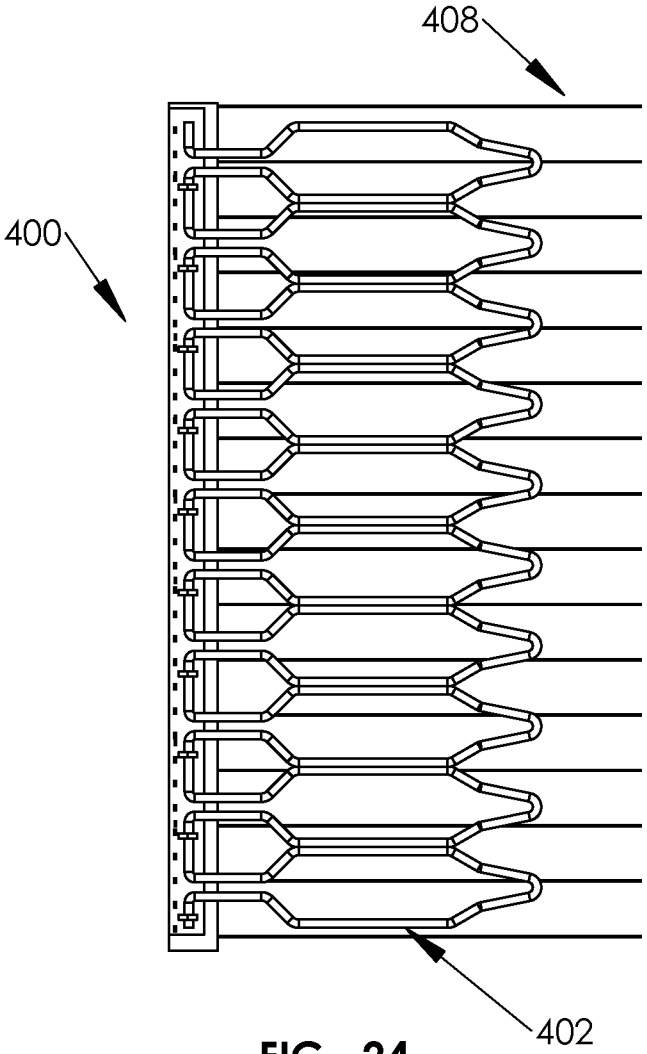
FIG. 24 is a front view of the fourth alternative hair extension clip system depicted in FIG. 23, in accordance with a thirty-ninth embodiment of the present invention.
Figure 23B:
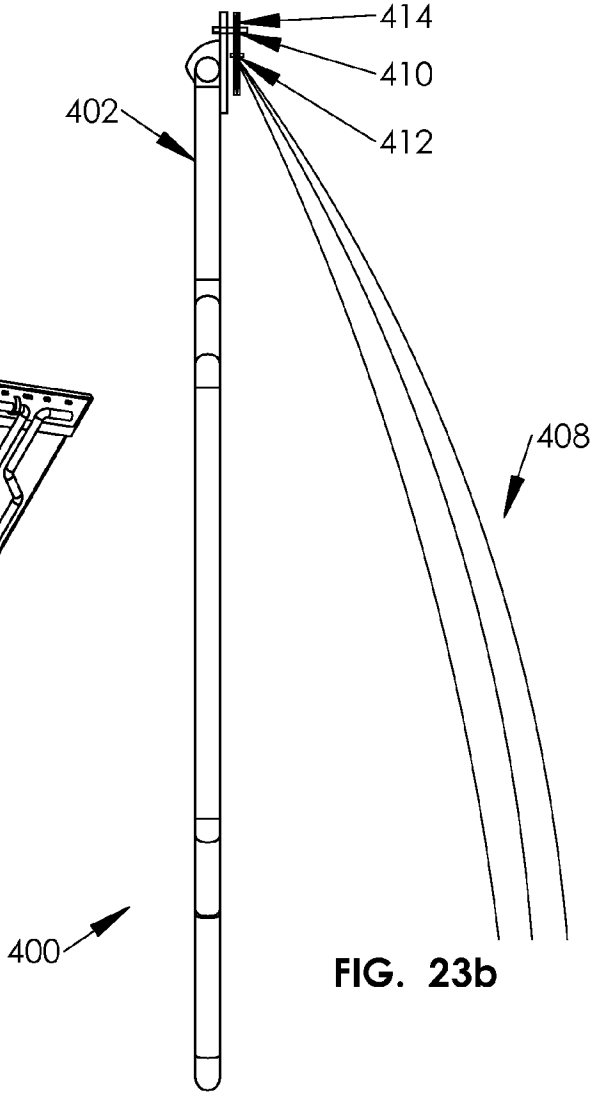
FIG. 23*b* is a side view of the fourth alternative hair extension clip system depicted in FIG. 25, in accordance with a thirty-eighth embodiment of the present invention.
Figure 23A:
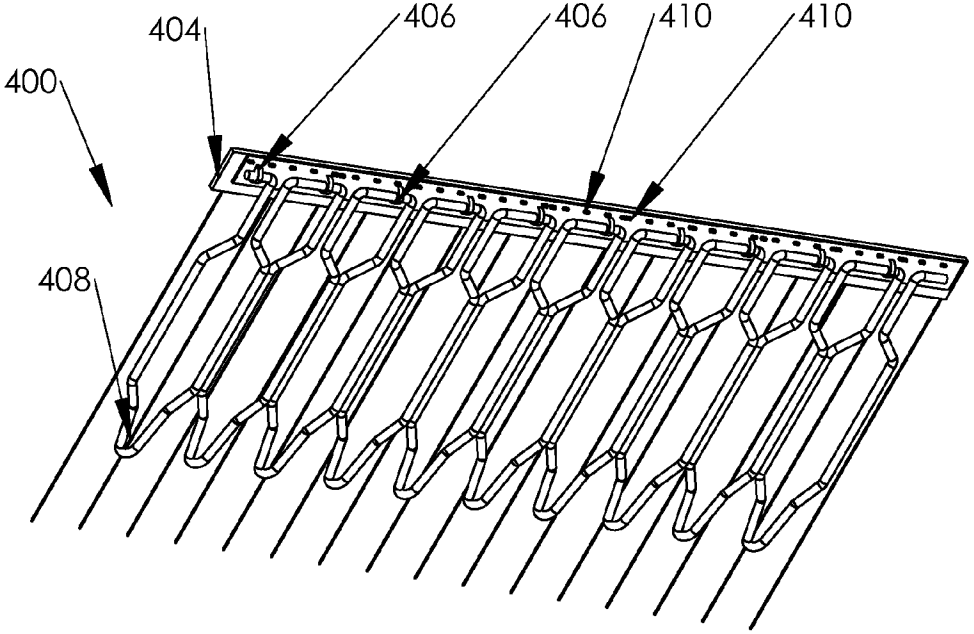
FIG. 23*a* is a partial broken away view of the fourth alternative hair extension clip system depicted in FIG. 25, in accordance with a thirty-seventh embodiment of the present invention.
Figure 25:
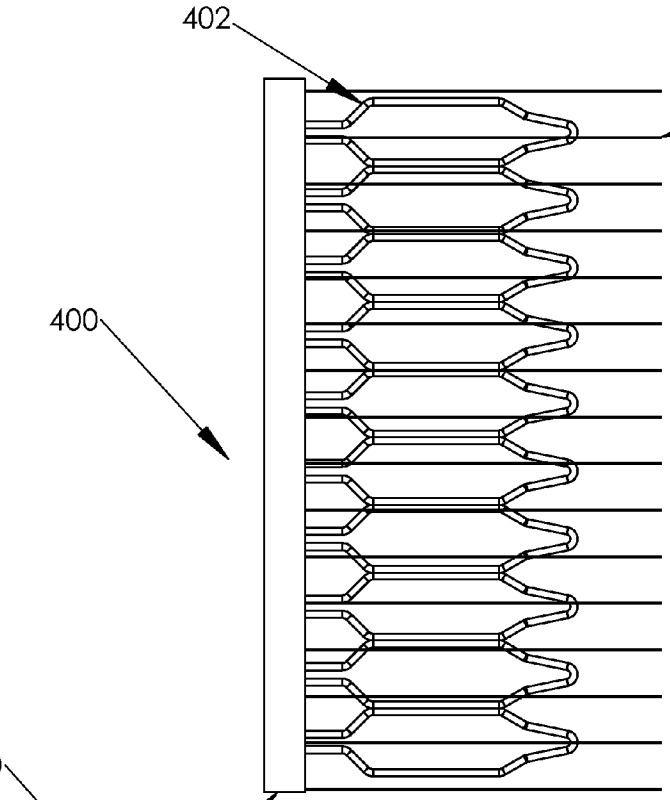
FIG. 25 is a rear view of the fourth alternative hair extension clip system depicted in FIG. 23, in accordance with a fortieth embodiment of the present invention.
Figure 26:
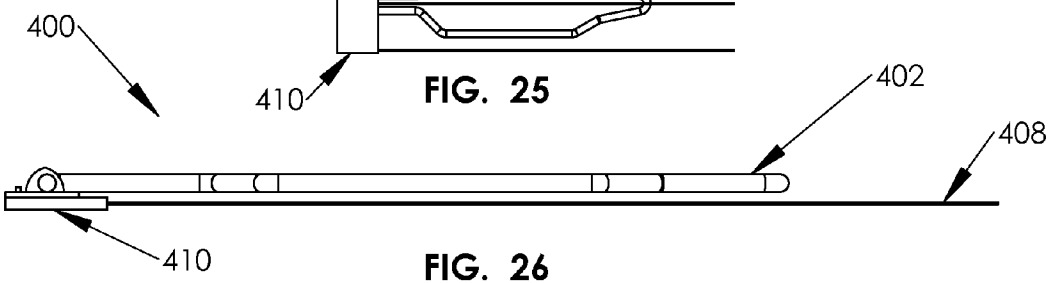
FIG. 26 is an elevational view of the fourth alternative hair extension clip system depicted in FIG. 23, in accordance with a forty-first embodiment of the present invention.
Figure 27:
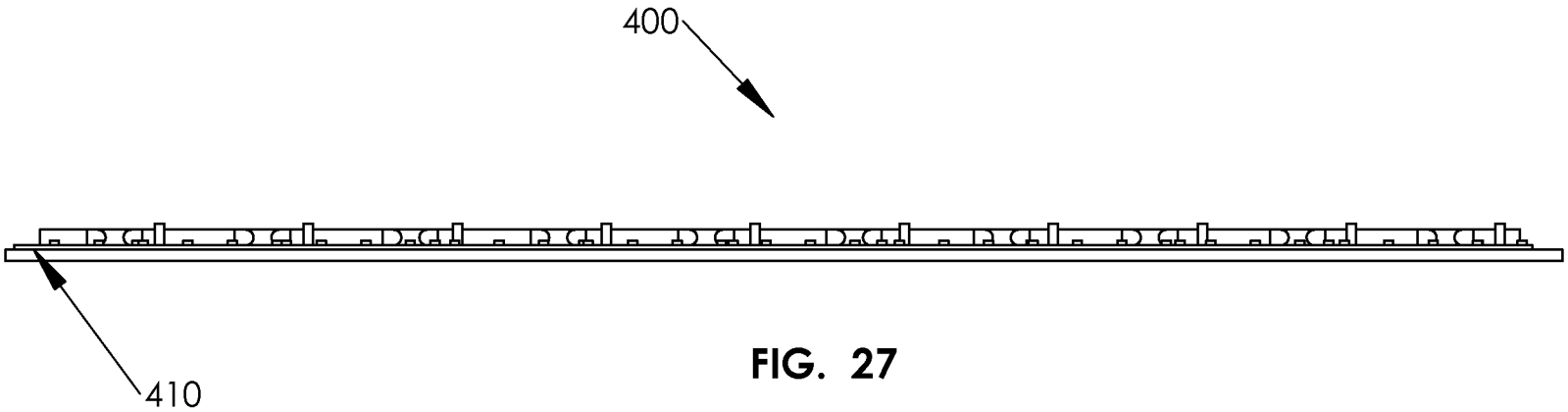
FIG. 27 is a top view of the fourth alternative hair extension clip system depicted in FIG. 23, in accordance with a forty-second embodiment of the present invention.
Figure 28:
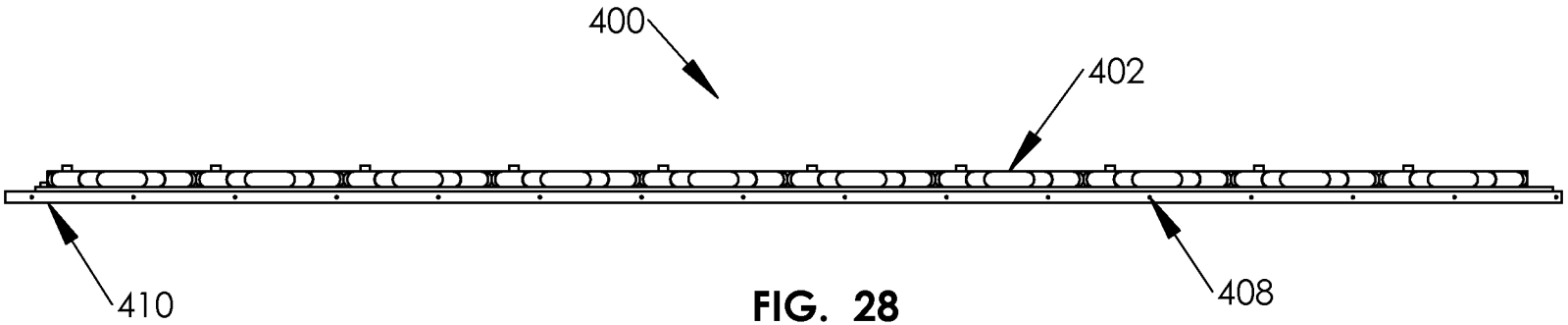
FIG. 28 is a bottom view of the fourth alternative hair extension clip system depicted in FIG. 23, in accordance with a forty-third embodiment of the present invention.

The following description of the preferred embodiment(s) is merely exemplary in nature and is in no way intended to limit the invention, or uses.

It should be appreciated that the phrases "hair weaves," "hair extensions," "hair pieces," and "hair portions," are being used interchangeably herein.

The following embodiments provide the wearer of hair weaves and hair extensions with a simple attachment system. By way of a non-limiting example, the hair weave or hair extension may be integrated with a comb-like attachment system in a relatively continuous fashion. Thus, the hair extension clip system of the present invention may be easily attached onto the wearer's existing natural and/or braided hair, and then as easily removed from the wearer's existing hair when so desired.

Referring to FIGS. 1-6, there is shown a hair extension clip system shown generally at 10. In this view, the hair weave portion 12 (which may consist of a single strand of hair, or more typically, a plurality of hair strands) is attached to a base member 14 via any number of suitable methods, including a stitch 16 or other fastening methods (e.g., a pin, a staple, gluing, and/or the like). The base member 14 may be comprised of any number of suitable materials; however, it is preferably comprised of a relatively flexible material such as, but not limited to, fabrics, impregnated paper, plastics, and/or the like. In this manner, the base member 14 may easily conform to the contours of the wearer's head/scalp.

The base member 14 may then be attached to an attachment strip member 18 via any number of suitable methods, including a stitch 20 or other fastening methods (e.g., a pin, a staple, gluing, and/or the like). The attachment strip member 18 may be comprised of any number of suitable materials; however, it is preferably comprised of a relatively flexible material such as, but not limited to fabrics, plastics, and/or the like, including plastics such as, but not limited to, relatively soft polymer/plastic materials such as, but not limited to, PVC, polypropylene, polyethylene, polyurethane, and/or elastomeric materials of various kinds or even impregnated papers. In this manner, the attachment strip member 18 may easily conform to the contours of the wearer's head/scalp.

The attachment strip member 18 may be provided with areas defining holes 22, which may be spaced apart from adjacent holes as shown. The intended purpose of the holes 22 is to permit the attachment of clip members 24, such that one or more leg portions 26 of the clip members 24 may be received through the holes 22, thus securely fastening the clip members 22 underneath the attachment strip member 18. The leg portions 26 are preferably provided on a top or upper portion of the clip member 24. Although two leg portions 26 are shown, it should be appreciated that less than or more than two leg portions may be used in conjunction with the practice of the present invention. By way of a non-limiting example, the leg portions 26 are substantially curved so as to prevent unintended disengagement with the holes 22. The clip members 24 may be comprised of any number of suitable materials; however, it is preferably comprised of metals, spring steel, plastics, and/or the like.

The clip members 24, when attached to the attachment strip member 18, allow for the secured attachment of the hair extension clip system 10 to the wearer's existing hair, including a wearer's dense and/or braided hair. By way of a non-limiting example, this arrangement allows the wearer to hold the hair extension clip system 10 such that the attachment strip member 18 and the clip member 24 may be held at an angle off the vertical, thus enabling the clip member 24 (specifically the base portion thereof) to relatively easily penetrate the wearer's dense and/or braided hair. A significant advantage for this arrangement is the ability to cut the attachment strip member 18 and the base member 14 with scissors or other suitable cutting device, without leaving a sharp end portion that may injure the wearer's scalp upon wearing the hair extension clip system 10. When it is desired to remove the hair extension clip system 10, the wearer simply pulls the clip members 24 up and out of the wearer's existing hair.

Referring to FIGS. 7-12, there is shown a first alternative hair extension clip system shown generally at 100. In this embodiment, there is a continuous clip member 102 (e.g., made from spring wire and/or plastic material) that is embedded within a molded-over attachment strip member 104 (e.g., made from fabric or soft plastic and/or elastomer material). It should be noted that although a substantially pentagon-shaped member is formed on the upper portion of the clip member 102, other configurations may be suitable as well. A fabric or soft plastic base member 106 may be attached to the attachment strip member 104, e.g., via a stitch 112. The hair weave portion 110 may then be sewn onto the base member 106, e.g., via a stitch 108.

The first alternative hair extension clip system 100 operates in the same basic manner as that previously described for hair extension clip system 10, e.g., with respect to the insertion and/or removal of the system from the wearer's existing hair.

Referring to FIGS. 13-18, there is shown a second alternative hair extension clip system shown generally at 200. The second alternative hair extension clip system 200 is very similar to the first alternative hair extension clip system 100 described above; however, in this embodiment areas defining holes 202 have been formed after the molding process and thus allows for relatively easy cutting to length through holes 202 without the need to cut the clip member 204 (which may be an elastic metal or plastic wire and/or the like). It should be noted that although a substantially pentagon-shaped member is formed on the upper portion of the clip member 102, other configurations may be suitable as well. Additionally, it should be noted that areas defining apertures are formed on a top member of the pentagon-shaped member. The cutting may occur through the attachment strip member 206 and the base member 208 and may be done with scissors. The afore-mentioned holes and apertures, which are preferably in proximity to one another, may facilitate the cutting process. The hair weave portion is shown at 210.

The second alternative hair extension clip system 200 operates in the same basic manner as that previously described for hair extension clip systems 10 and 100, e.g., with respect to the insertion and/or removal of the system from the wearer's existing hair.

Referring to FIGS. 19-24, there is shown a third alternative hair extension clip system shown generally at 300. In this embodiment, an attachment profile member 302 is preferably formed of a flexible plastic or elastomer material (or even impregnated paper). A continuous clip member 304 may be attached to the attachment profile member 302 by placing the top portion of the clip member 304 within the attachment profile member 302 and then bending the attachment profile member 302 over the clip member 304 (e.g., so as to form two substantially parallel major faces of the attachment profile member 302) such that adhesives (or thermal fusion) of the attachment profile member 302 may create a relatively durable bond between the attachment profile member 302 and the clip member 304. It should be appreciated that the same arrangement may also be done by placing individual clip members (not shown) within the attachment profile member 302 and then bonding or fusing the "bent" the attachment profile member 302 onto the individual clip members. As with the previously described embodiments, a fabric or soft plastic base member 306 may be attached to the attachment profile member 302 via a stitch 308. The hair weave portion 310 may then be sewn onto the base member 306 via a stitch 312.

The third alternative hair extension clip system 300 operates in the same basic manner as that previously described for hair extension clip systems 10, 100, and 200, e.g., with respect to the insertion and/or removal of the system from the wearer's existing hair.

Referring to FIGS. 25-30, there is shown a fourth alternative hair extension clip system shown generally at 400. In this embodiment, there is shown a continuous "comb" or clip member 402 that may be attached onto the attachment strip member 404 via one or more stitches 406. The hair weave portion 408 may be attached to a fabric or soft plastic base member 410 via a stitch 412. The same base member 410 may be sewn onto the attachment strip member 404 via a stitch 414.

The fourth alternative hair extension clip system 400 operates in the same basic manner as that previously described for hair extension clip systems 10, 100, 200, and 300, e.g., with respect to the insertion and/or removal of the system from the wearer's existing hair.

Figure 31:
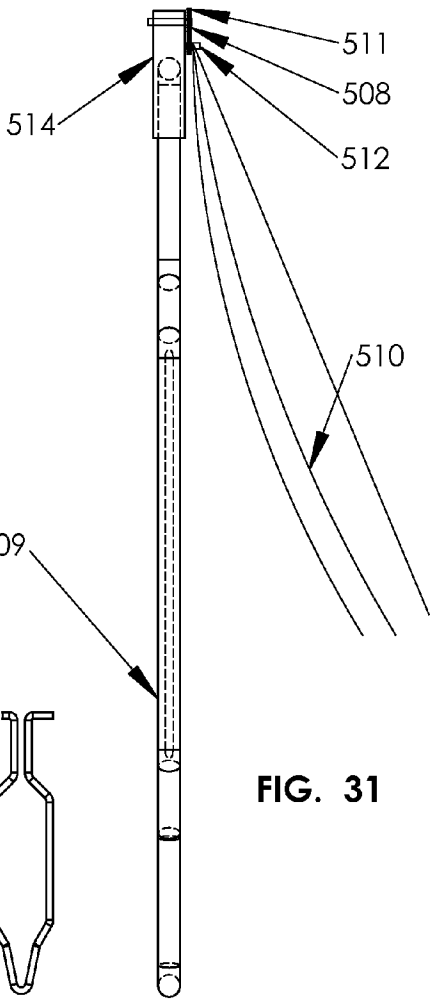
FIG. 31 is a side view of the fifth alternative hair extension clip system depicted in FIG. 29, in accordance with a forty-sixth embodiment of the present invention.
Figure 29:
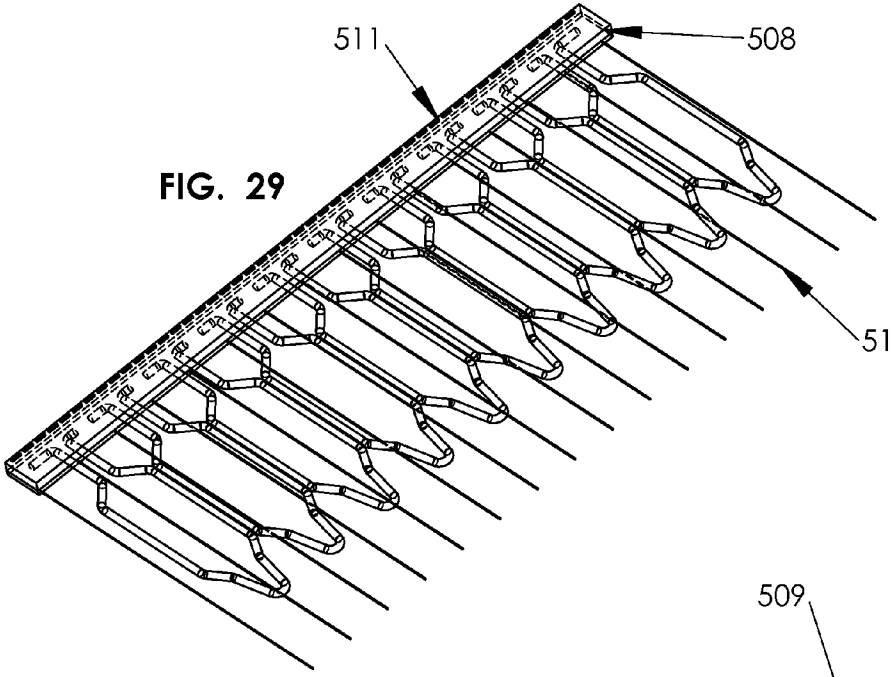
FIG. 29 is a perspective view of a fifth alternative hair extension clip system, in accordance with a forty-fourth embodiment of the present invention.
Figure 30:
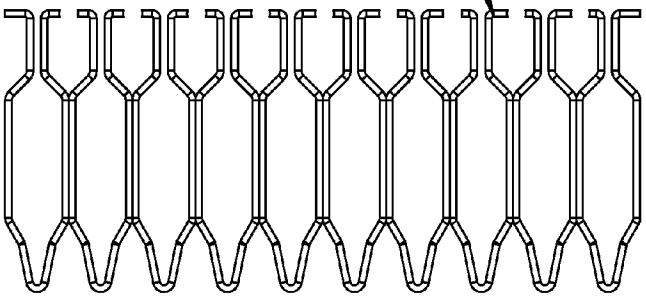
FIG. 30 is an elevational view of a hair clip member of the fifth alternative hair extension clip system depicted in FIG. 29, in accordance with a forty-fifth embodiment of the present invention.

Referring to FIGS. 29-31, there is shown a fifth alternative hair extension clip system shown generally at 500. The hair weave assembly 500 includes hair weave 510 that may be attached to a fabric or soft plastic base member 508 via stitch 512. The base member 508 may be attached to the attachments strip member 514 via stitch 511. The individual clip member 509 may be held in a mold where the attachment strip member 508 may be being molded over the clip member 509, thus fusing or otherwise securing clip member 509 onto the attachment strip member 514. Cutting the assembly is done easily with scissors, or other cutting devices, e.g., by applying the cut between clip members 509, thus cutting attachment strip member 514 and base member 658 simultaneously.

The fifth alternative hair extension clip system 500 operates in the same basic manner as that previously described for hair extension clip systems 10, 100, 200, 300, and 400, e.g., with respect to the insertion and/or removal of the system from the wearer's existing hair.

It should be noted that, in most cases, gluing or other chemical/mechanical fastening methods, may replace stitching if so desired. Additionally, it should be appreciated that the clip members may be selectively operable to pivot or otherwise rotate relative to the attachment strip member so as to facilitate placement of the hair extension clip system into the wearer's hair.

Figure 33:
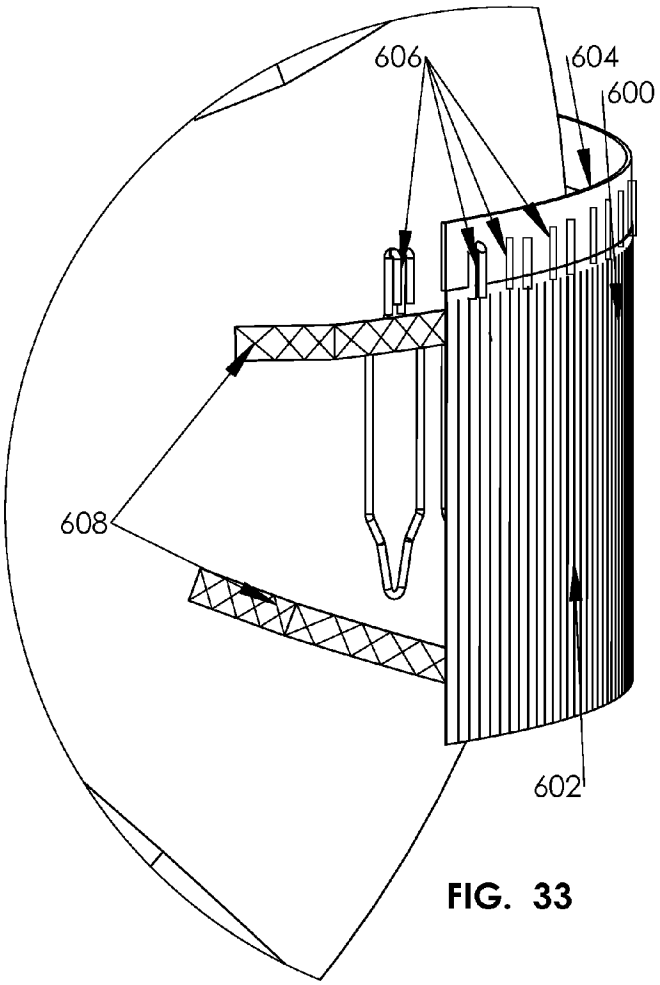
FIG. 33 is a detailed view of FIG. 32, in accordance with a forty-eighth embodiment of the present invention.
Figure 32:
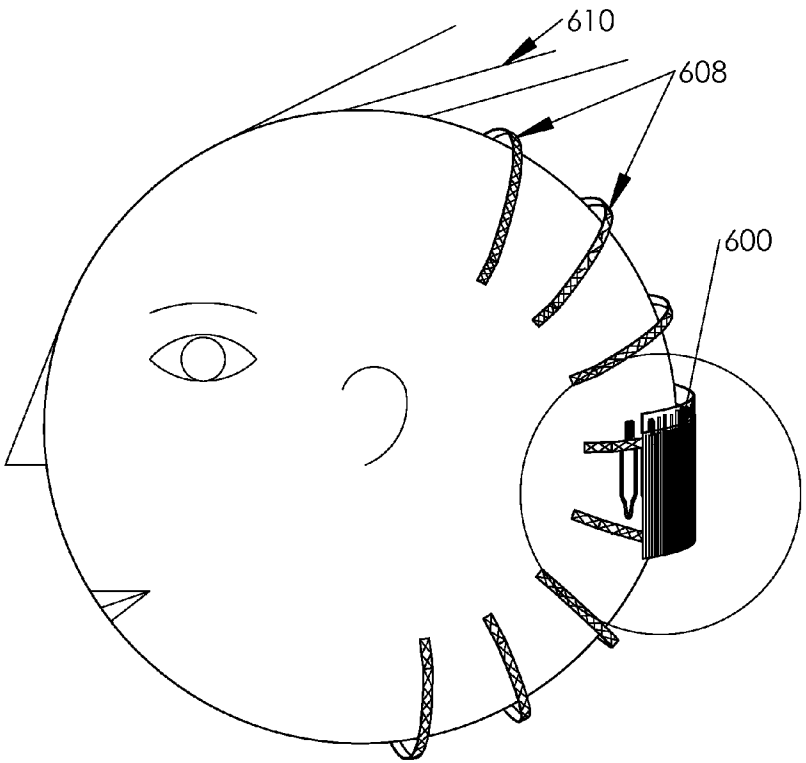
FIG. 32 is a perspective view of a hair extension clip system of the present invention attached to the existing hair of a wearer, in accordance with a forty-seventh embodiment of the present invention.

Referring to FIGS. 32 and 33, there is shown a hair weave assembly 600 (which may include any of the features of the previously described embodiments) where the hair weave portion 602 may be attached to an attachment strip member 604. A stand-alone clip member 606 is shown here for purposes of clarity.

Upon attaching the hair weave assembly 600 to the wearer's hair braids 608, the clip members 606 may become anchored within the braid of hair as shown. The attachable hair weave assemblies 600 may be hidden by the wearer's own hair 610 (e.g., when combed backwards), thus covering the top braids and the weave assemblies 600 attachment strip members 604, and the top weave assemblies 600 may then cover the lower braids, e.g., as shown in FIG. 33.

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A hair extension clip system, comprising:
- a hair extension member, wherein the hair extension member includes a plurality of hair strands;
- a base member, wherein the hair extension member is fastened to a portion of the base member;
- a flexible, linear attachment strip member, wherein the attachment strip member is conformable to a contour of a scalp of a wearer, wherein the base member is fastened to a portion of the attachment strip member; and
- a clip member, wherein a portion of the clip member is operably associated with the attachment strip member;
- wherein the clip member is selectively operable to engage a portion of the wearer's existing hair;
- wherein the attachment strip member includes at least one area defining an aperture formed therein;
- wherein the clip member includes a base portion and a curved leg portion formed thereon;
- wherein the curved leg portion is selectively operable to be received in the aperture so as to permit the clip member to be operably associated with the attachment strip member;
- wherein, when the curved leg portion is received in the aperture, the clip member is selectively operable to pivot relative to the attachment strip member.

2. The hair extension clip system according to claim 1, wherein the base portion of the clip member is selectively operable to engage a portion of a wearer's existing hair.

3. The hair extension clip system according to claim 1, wherein the curved leg portion includes at least one curved leg member.

4. The hair extension clip system according to claim 1, wherein the curved leg portion includes a pair of leg members.

5. The hair extension clip system according to claim 1, wherein the curved leg portion includes a pair of curved leg members.

6. The hair extension clip system according to claim 1, wherein the attachment strip member includes a first major face and a substantially parallel second major face.

7. The hair extension clip system according to claim 6, wherein a portion of the clip member is selectively operable to be positioned between the first and second major faces of the attachment strip member.

8. The hair extension clip system according to claim 6, wherein a portion of the clip member is selectively operable to be retained between the first and second major faces of the attachment strip member.

9. A hair extension clip system, comprising:
- a hair extension system;
- an attachment strip member, wherein a portion of the hair extension system is fastened to a portion of the attachment strip member; and
- a clip member, wherein a portion of the clip member is operably associated with the attachment strip member;
- wherein the clip member is selectively operable to engage a portion of a wearer's existing hair;

wherein the clip member includes a top portion and a bottom portion;

wherein the top portion includes a pentagon-shaped member.

10. The hair extension clip system according to claim 9, wherein the hair extension system includes a hair extension member and a base member, wherein the hair extension member is fastened to a portion of the base member.

11. The hair extension clip system according to claim 10, wherein the hair extension member includes a plurality of hair strands.

12. The hair extension clip system according to claim 9, wherein the attachment strip member includes at least one area defining an aperture formed therein.

13. The hair extension clip system according to claim 12, wherein the clip member includes a base portion and a leg portion formed thereon.

14. The hair extension clip system according to claim 13, wherein the leg portion is selectively operable to be received in the aperture so as to permit the clip member to be operably associated with the attachment strip member.

15. The hair extension clip system according to claim 13, wherein the base portion of the clip member is selectively operable to engage a portion of a wearer's existing hair.

16. The hair extension clip system according to claim 9, wherein the top portion includes at least one leg member.

17. The hair extension clip system according to claim 9, wherein the top portion includes a pair of leg members.

18. The hair extension clip system according to claim 9, wherein the top portion includes a pair of curved leg members.

19. The hair extension clip system according to claim 9, wherein the pentagon-shaped member includes a top member having an area defining an aperture formed therein.

20. The hair extension clip system according to claim 9, wherein the attachment strip member includes a first major face and a substantially parallel second major face.

21. The hair extension clip system according to claim 20, wherein a portion of the clip member is selectively operable to be positioned between the first and second major faces of the attachment strip member.

22. The hair extension clip system according to claim 20, wherein a portion of the clip member is selectively operable to be retained between the first and second major faces of the attachment strip member.

23. The hair extension clip system according to claim 9, wherein a portion of the clip member is fused to a portion of the attachment strip member.

24. The hair extension clip system according to claim 9, wherein the clip member is selectively operable to pivot relative to the attachment strip member.

25. A hair extension clip system, comprising:

a hair extension member, wherein the hair extension member includes a plurality of hair strands;

a base member, wherein the hair extension member is fastened to a portion of the base member;

a flexible, linear attachment strip member, wherein the attachment strip member is conformable to a contour of a scalp of a wearer, wherein the base member is fastened to a portion of the attachment strip member; and a clip member, wherein a portion of the clip member is operably associated with the attachment strip member;

wherein the clip member is selectively operable to engage a portion of the wearer's existing hair;

wherein the attachment strip member includes at least one area defining an aperture formed therein;

wherein the clip member includes a top portion and a bottom portion;

wherein the top portion includes a curved leg portion formed thereon;

wherein the curved leg portion is selectively operable to be received in the aperture so as to permit the clip member to be operably associated with the attachment strip member;

wherein, when the curved leg portion is received in the aperture, the clip member is selectively operable to pivot relative to the attachment strip member.

26. The hair extension clip system according to claim 25, wherein the curved leg portion includes at least one curved leg member.

27. The hair extension clip system according to claim 25, wherein the curved leg portion includes a pair of leg members.

28. The hair extension clip system according to claim 25, wherein the curved leg portion includes a pair of curved leg members.

29. The hair extension clip system according to claim 25, wherein the top portion includes a pentagon-shaped member.

30. The hair extension clip system according to claim 29, wherein the pentagon-shaped member includes a top member having an area defining an aperture formed therein.

* * * * *